US005713290A

United States Patent [19]

Huang

[11] Patent Number: 5,713,290

[45] Date of Patent: Feb. 3, 1998

[54] COMBUSTION FURNACE FOR COMBUSTIBLE RUBBISH

[76] Inventor: C. J. Huang, No.47-1 Fanpalin Road, Shipan Chuen, San-Chi Shiang, Taipei Hsien, Taiwan

[21] Appl. No.: 761,680

[22] Filed: Dec. 6, 1996

[51] Int. Cl.[6] ..... F23B 5/00

[52] U.S. Cl. ..... 110/235; 110/214

[58] Field of Search ..... 110/215, 216, 110/235, 246, 345; 403/105, 103

[56] References Cited

U.S. PATENT DOCUMENTS 3,745,939 7/1973 Allbritton ..... 110/212

5,363,777 11/1994 Yoshimoto et al. ..... 110/215

5,570,644 11/1996 Cheng ..... 110/215

*Primary Examiner*—Henry A. Bennett

*Assistant Examiner*—Pamela A. O'Connor

*Attorney, Agent, or Firm*—The Kline Law Firm

[57] ABSTRACT

A combustion furnace for combustible rubbish, allowing to utilize the generated heat for everyday purposes, wherein the rubbish is burned in several combustion chambers inside a main body, allowing for heating a cooking device, and the generated smoke flows through a separating plate below the combustion chambers, is dispersed by a sprinkling device and passes through a filter, such that it will not pollute the environment.

10 Claims, 9 Drawing Sheets

COMBUSTION FURNACE FOR COMBUSTIBLE RUBBISH

BACKGROUND OF THE INVENTION

1. Field of the Invention

The present invention relates to a combustion furnace for combustible rubbish, particularly for taking advantage of combustible rubbish.

2. Description of Related Art

The modern problem of waste generation cannot be ignored. Every year vast amounts of money and resources are spent on this problem, without solving it. In modern communities, rubbish is sorted, which is fast and inexpensive and minimizes the impact on the environment. The majority of people, however, do not see any direct advantage of sorting rubbish and so hardly undertake the effort of doing it. Therefore, the best solution for handling the problem of too much rubbish is one that shows a clear benefit to the majority of people.

SUMMARY OF THE INVENTION

The main object of the present invention is to provide a combustion furnace for utilizing combustible rubbish, so as to reduce waste.

Another object of the present invention is to provide a combustion furnace for combustible waste, which is economically advantageous.

A further object of the present invention is to provide a combustion furnace for combustible waste, which does not pollute the environment.

The present invention can be more fully understood by reference to the following description and accompanying drawings.

DETAILED DESCRIPTION OF THE PREFERRED EMBODIMENTS

Figure 1:
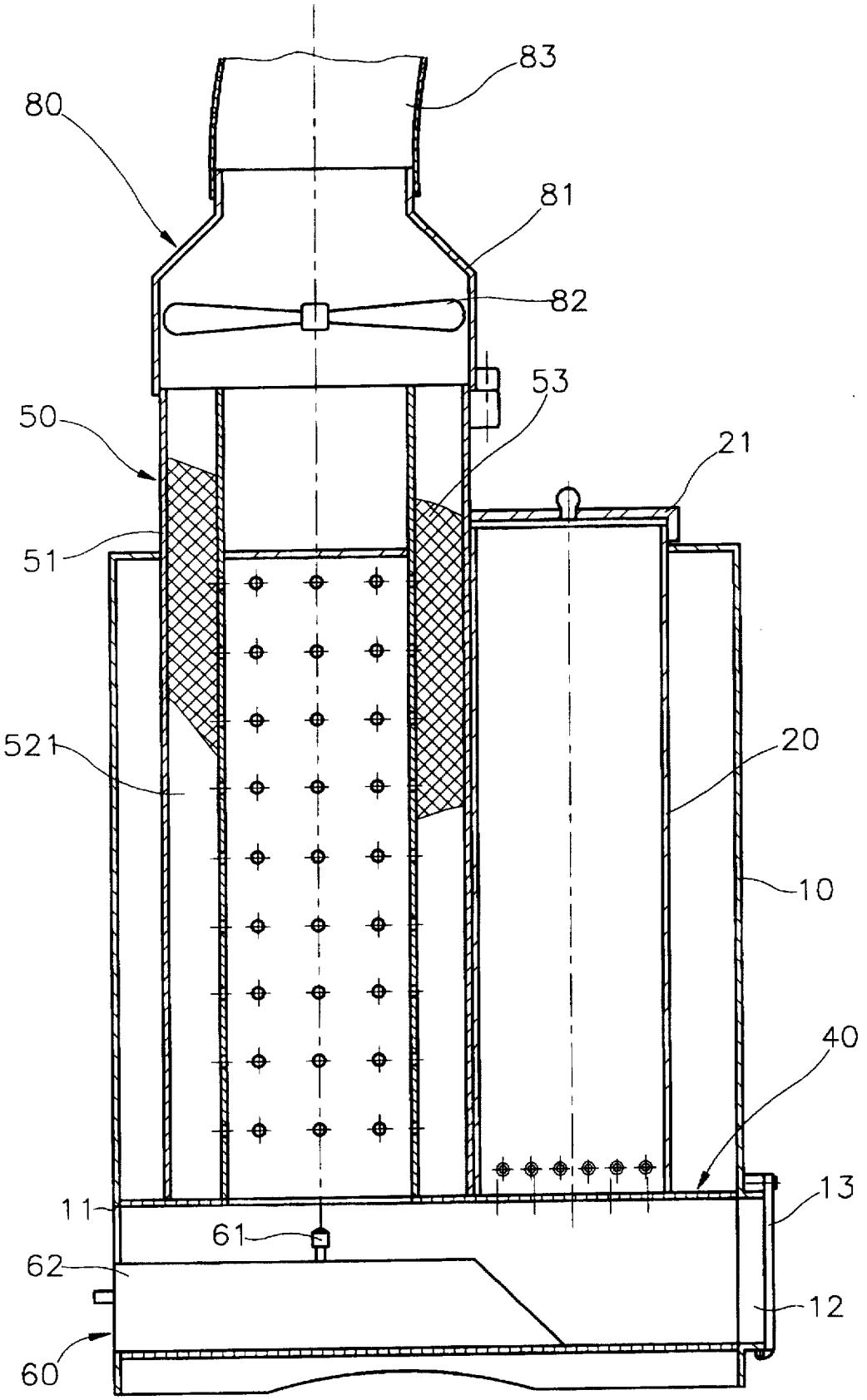
FIG. 1 is an elevational view in section of the assembly of the parts of the present invention.

As shown in all figs., the combustion furnace of the present invention is used to burn rubbish 1, while the heat generated in the process is usable for everyday purposes. The combustion furnace of the present invention mainly comprises: a main body 10; several combustion chambers 20 in the main body 10, the heat of which is usable for a cooking device 30; a separating plate 40, which is passed through by the smoke generated in the combustion chambers 20; a filter 50 for filtering the smoke; and a sprinkling device 60 for spraying the smoke with water, before it passes through the filter 50.

Referring to FIG. 1, the main body 10 is formed as a cylindrical vessel, which has a hole 11 on its convex surface near the bottom. The sprinkling device 60 (described later) is inserted through the hole 11 into the main body 10. On the convex surface near the bottom of the main body 10, opposite to the hole 11, there is another hole 12, which serves as an access to the interior of the main body 10, in order to remove ash. The hole 12 is covered by a lid 13, sealing the main body 10, when rubbish is burned.

Figure 3:
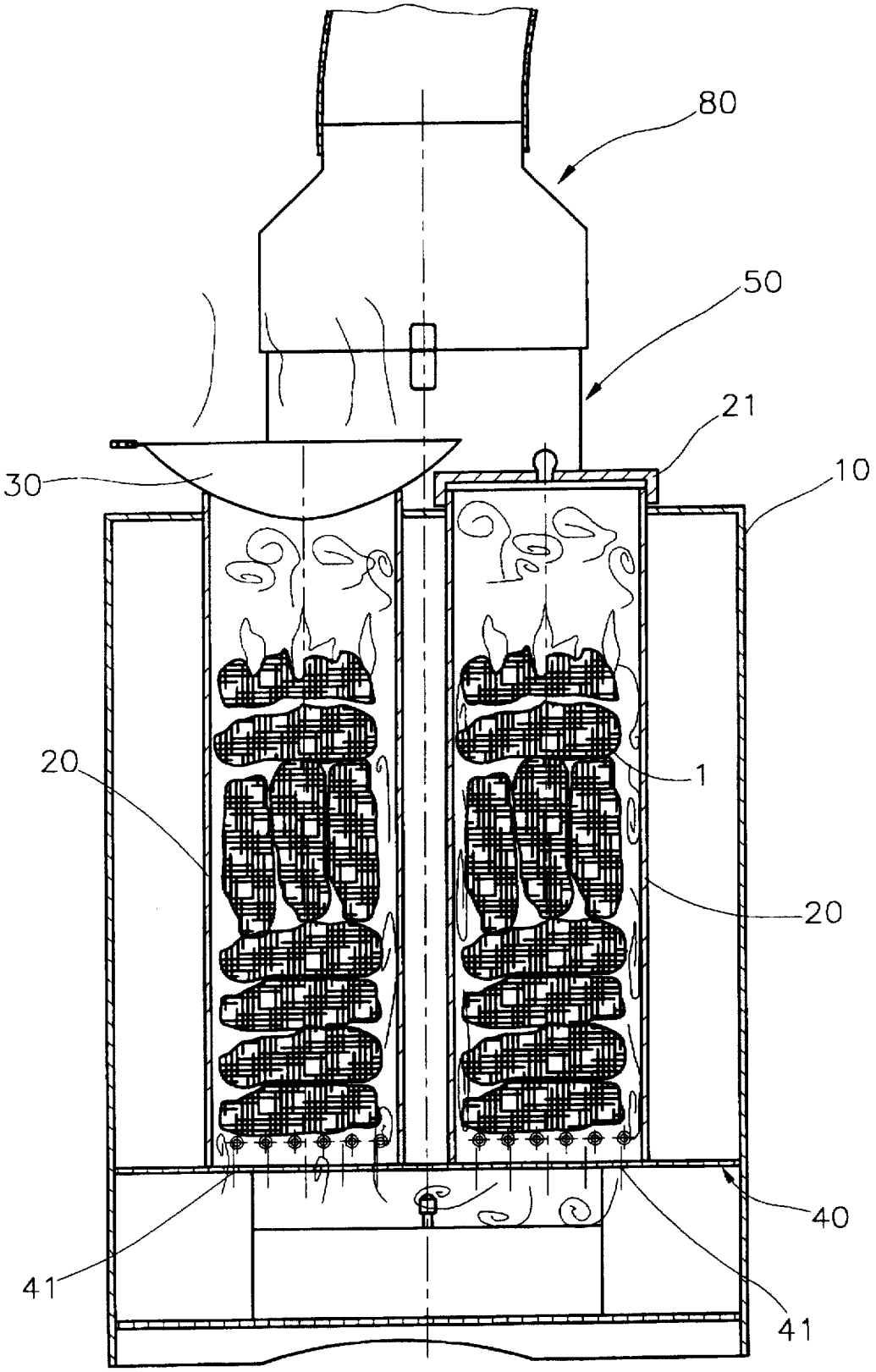
FIG. 3 is a schematic illustration, showing how a cooking device is heated by the furnace of the present invention.

As shown in FIGS. 1 and 3, inside the main body 10 several combustion chambers 20 are mounted, keeping a certain distance from each other. Each of the combustion chambers 20 is shaped like a vertically oriented tube with open ends. The upper ends of the combustion chambers 20 extend beyond the top side of the main body 10, and the lower ends of the combustion chambers 20 keep a distance from the bottom side of the main body 10. In the combustion chambers 20 the rubbish 1 is burned. The upper end of each of the combustion chambers 20 is tightly covered by a lid 21, such that no smoke escapes. Each lid 21 can be opened by turning, in order to throw in the rubbish 1 to be burned. Optionally a combustion chamber 20 may be covered by a cooking device 30 to use the heat generated in the burning process.

Figure 2:
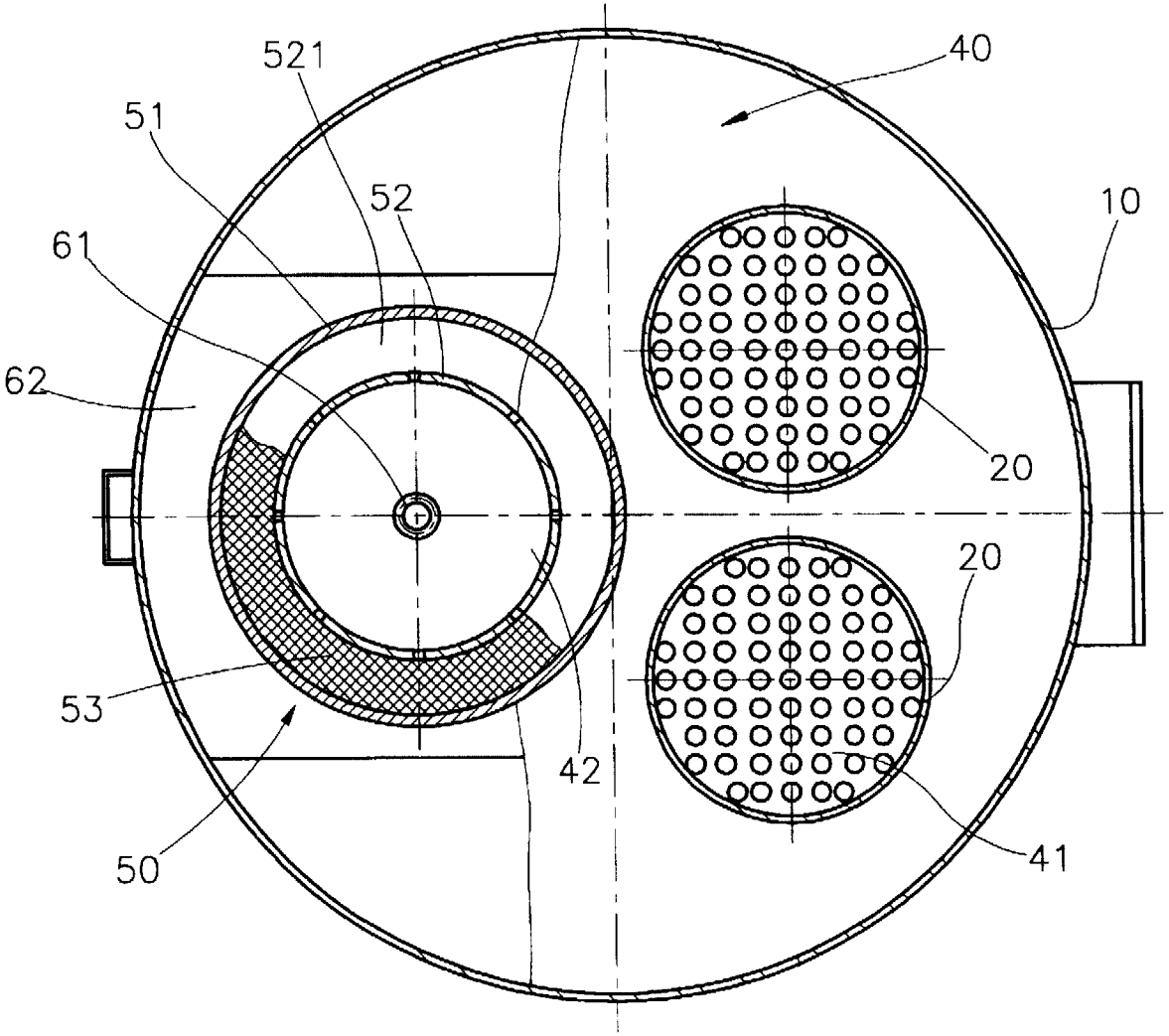
FIG. 2 is a plan view in section of the present invention, showing the positions of the holes and the opening for the flow of smoke.

As shown in FIGS. 2 and 3, the lower ends of the combustion chambers 20 sit on the separating plate 40. The separating plate 40 is horizontally fixed to the inner side of the convex surface of the main body 10 near the bottom side thereof. It prevents the rubbish 1 from falling to the bottom of the main body 10. A plurality of holes 41 are bored through the separating plate 40 in the areas inside the perimeters of the combustion chambers 20. When the rubbish 1 is burned in the combustion chambers 20, hot gas and smoke generated in that process pass through the holes 41. At the same time, a cooking device 30 can be placed on the upper end of any of the combustion chambers 20, using the generated heat (as shown in FIG. 3). The separating plate is further provided with an eccentric opening 42, which is located at a certain distance from the combustion chambers 20 and connects the space below the separating plate 40 to the filter 50. Thereby, smoke from the combustion chambers 20 first flows through the holes 41, then through the opening 42 to reach the filter 50.

The filter 50 comprises an outer casing 51, an inner tube 52, and filter material 53. The outer casing 51 is shaped like a tube with open ends and is vertically mounted inside the main body 10. Its upper end extends beyond the upper side of the main body 10 as well as beyond the upper ends of the combustion chambers 20. Its lower end sits on the separating plate 40. The inner tube 52 is mounted vertically inside the outer casing 51 on the separating plate 40. It is open on the lower side and its perimeter coincides with the circumference of the opening 42. Between the convex surfaces of the inner tube 52 and the outer casing 51 there is an accommodating space 521, which is filled by the filter material 53. The convex surface of the inner tube 52 is provided with a plurality of holes 522, which connect the space inside the inner tube 52 to the accommodating space 521. Thus, smoke flowing through the opening 42 into the inner tube 52 enters the accommodating space 521 and is filtered by the filtering material 53. The filtered smoke finally is released through a gas outlet 80. Therefore no unfiltered smoke from the burning process will pollute the environment.

The gas outlet 80 is mounted on top of the filter 50. It comprises a casing 81, which is roughly shaped like a tube open on both ends. The casing 81 is put on the outer casing 51 of the filter 50. Inside the casing 81 a fan 82 is mounted, which draws up the filtered smoke from the filter 50. Thus the smoke generated when burning the rubbish 1 in the combustion chamber 20 enters the filter 50 through the opening 42 in the separating plate 40 and is released through the outlet 80. A flexible tube 83 is put on the casing 81 of the outlet 80, so as to lead away the filtered smoke.

Figure 4:
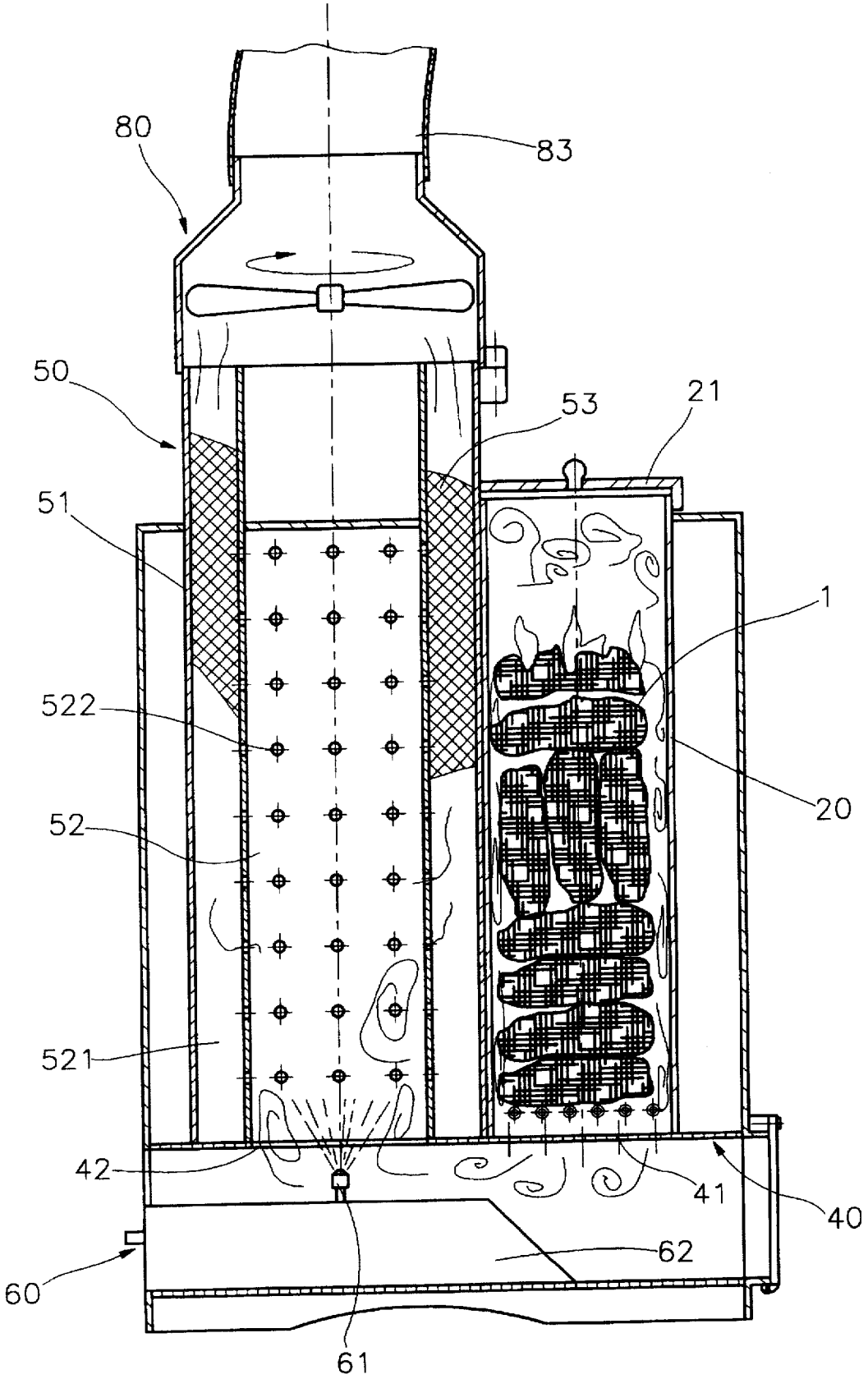
FIG. 4 is a schematic illustration, showing the dispersion of smoke in the present invention.

Referring to FIGS. 1 and 4, the sprinkling device 60 is inserted through the hole 11 into the main body 10. The sprinkling device 60 comprises a sprinkler 61 and a water tank 62. The water spray of the sprinkler 61 is directed towards the entrance of the inner tube 52 of the filter 50, such that the dense smoke entering the inner tube 52 disperses uniformly and thus stays longer in the filter 50. The water tank 62 is a vessel, which is open at the top, with the opening corresponding to the entrance of the inner tube 52 of the filter 50. Thereby the water that has been sprayed by the sprinkler 61 and drops back enters the water tank 62 and is thus recycled.

Since the combustion furnace for combustible rubbish of the present invention releases only smoke which has been filtered in the filter 50, the air will not be polluted. Furthermore, the heat generated in the combustion process is usable for everyday life purposes. So this invention not only contributes to saving energy, but also reduces the quantity of waste.

Figure 5:
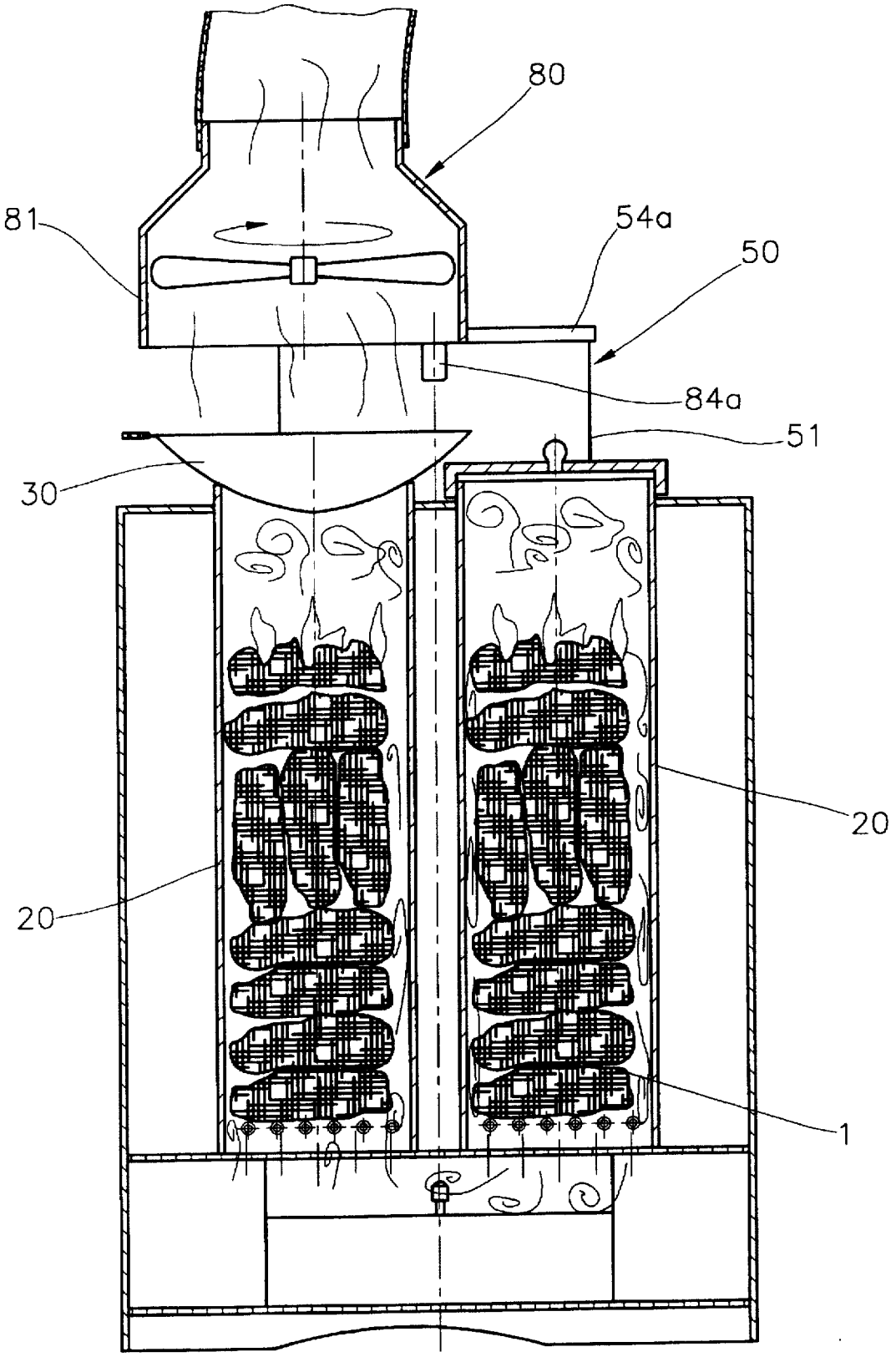
FIG. 5 is an elevational view in section of the present invention in a second embodiment.

As shown in FIG. 5, this invention in a second embodiment has a rotatable holder 84*a*, on which the casing 81 is mounted and which is connected to the outer casing 51 of the filter 50. Thereby the gas outlet 80 is revolvable around the rotatable holder 84*a* and can be placed above the cooking device 30 on any of the combustion chambers 20, in order to draw away the oily air coming from the cooking device 30. At the same time, a lid 54*a* closes the area on the upper side of the filter 50 which is not covered by the gas outlet 80. So the hot gas and filtered smoke coming from the filter 50 are forced through the gas outlet 80, and the heating effect is increased.

Figure 6:
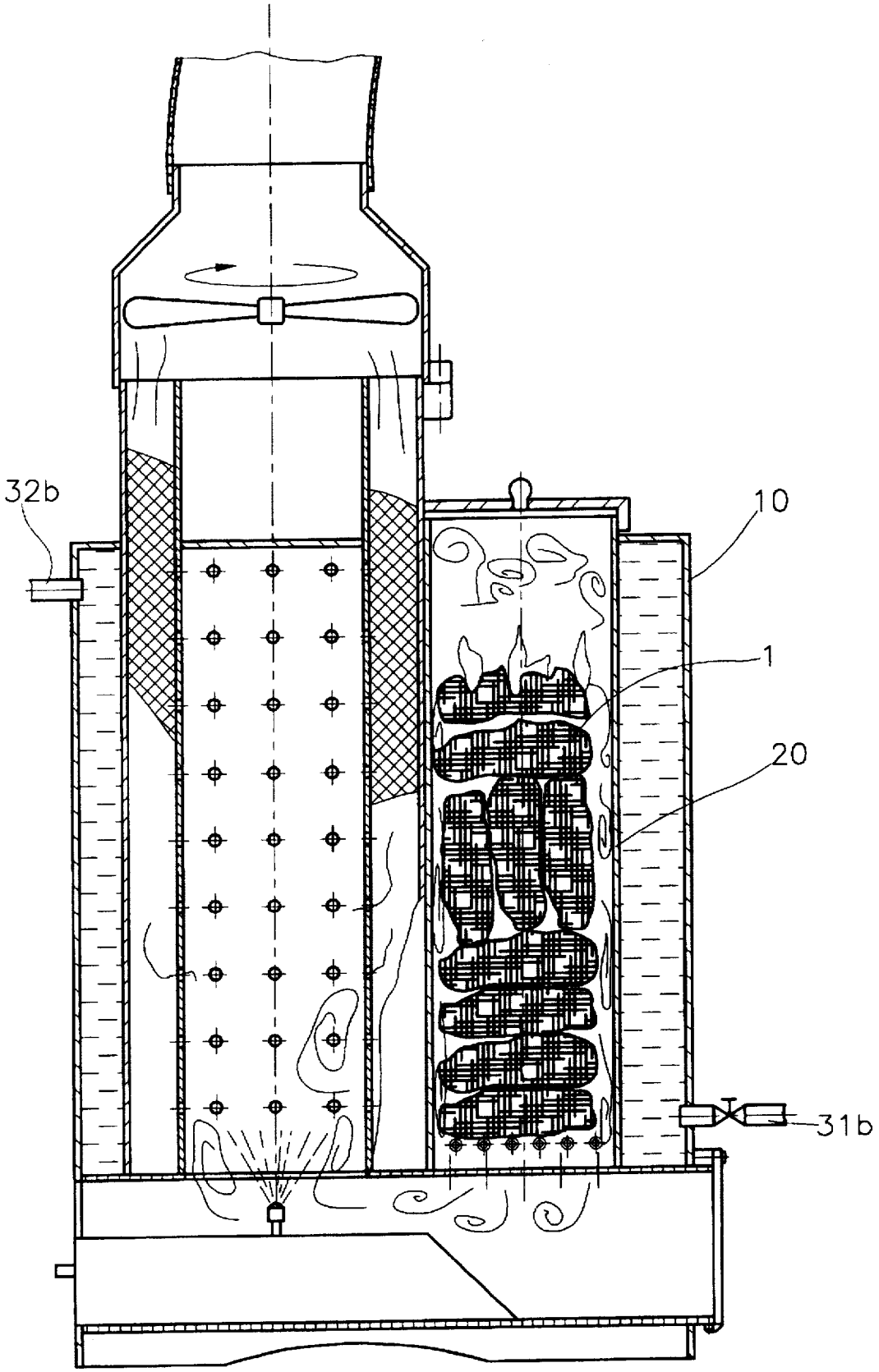
FIG. 6 is an elevational view in section of the present invention in a third embodiment.

FIG. 6 shows a third embodiment of the present invention, wherein the main body is provided with a water inlet 32*b*. A water source is connected to the outer end of the water inlet valve 32*b*. The main body 10 outside the combustion chambers 20 and the filter 50 is filled with water, which is heated by burning the rubbish 1 in the combustion chambers 20. The heated water is taken out through a water outlet 31*b* and may be used for washing or bathing.

Figure 7:
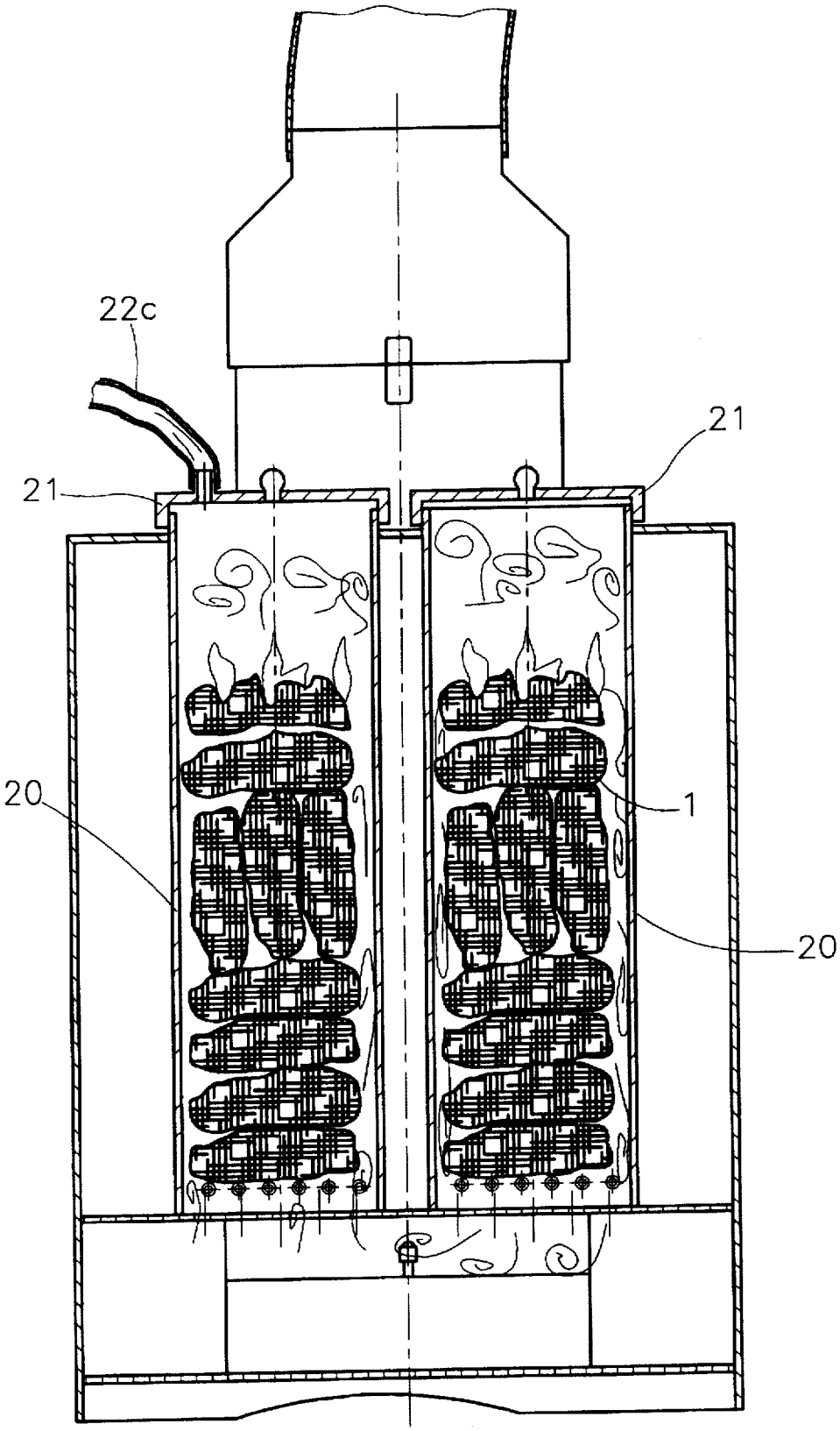
FIG. 7 is an elevational view in section of the present invention in a fourth embodiment.

Referring to FIG. 7, in a fourth embodiment of the present invention, one of the lids 21 on the combustion chambers 20 is passed through by an outlet tube 22*c*. The outlet tube 22*c* leads to another furnace. Hot gases generated when burning the rubbish 1 in the combustion chambers 20 reach the other furnace to increase the heat therein. In this embodiment, one of the combustion chambers may not contain any burning rubbish at all, while the outlet tube 22*c* is connected to this combustion chamber. Since all the combustion chambers are tightly closed to the environment and connected to each other via the holes 41 in the separating plate, then hot gases will still flow out through the outlet tube 22*c*.

Figure 8:
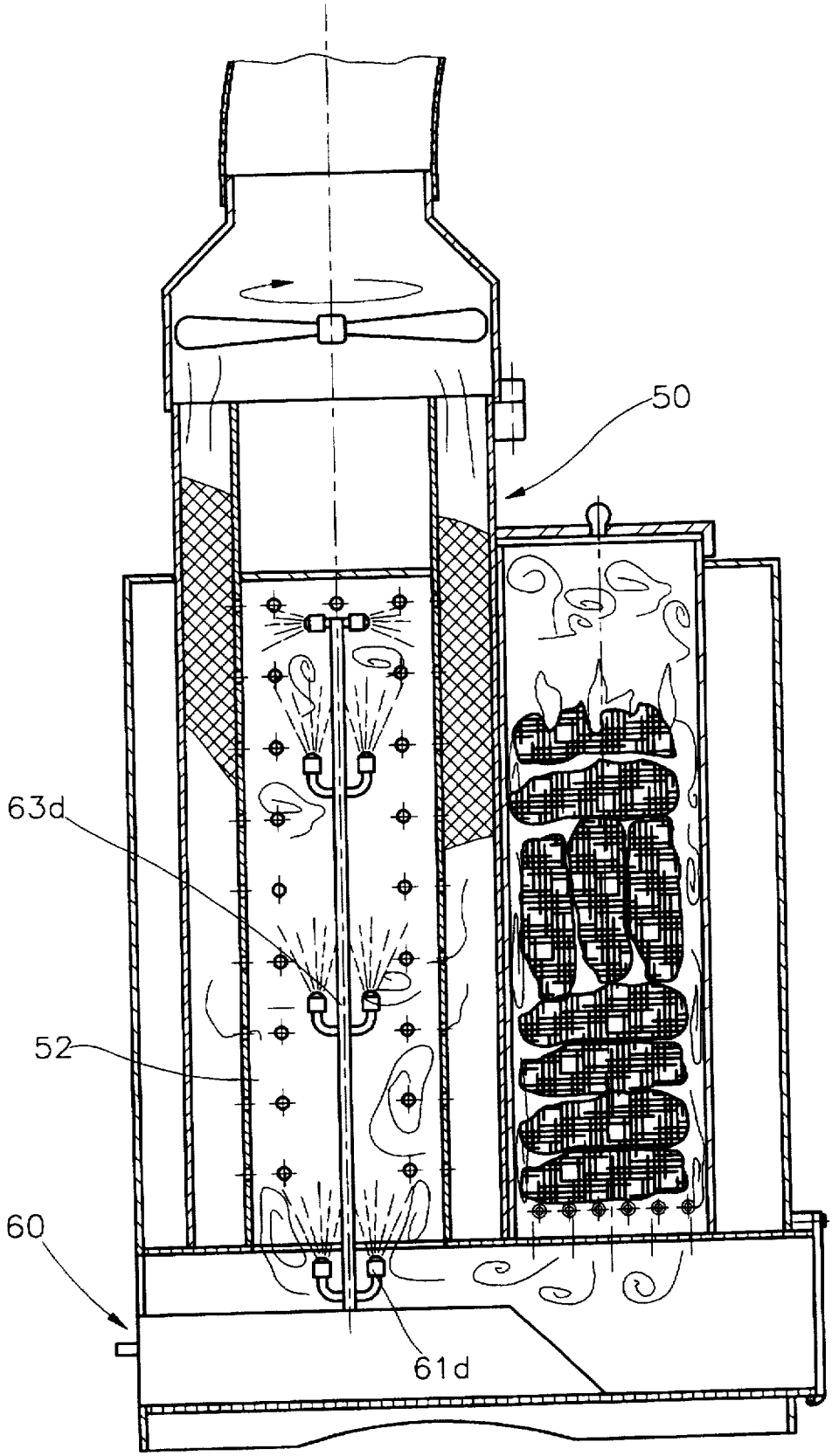
FIG. 8 is an elevational view in section of the present invention in a fifth embodiment.

Referring to FIG. 8, in a fifth embodiment of the present invention, the sprinkler 61 of the first embodiment is replaced by a plurality of sprinklers 61*d*. The sprinklers 61*d* are connected to the water supply by a tube 63*d*. They are placed inside the inner tube 52 of the filter 50, so as to increase the sprayed volume and thus disperse the smoke more efficiently.

Figure 9:
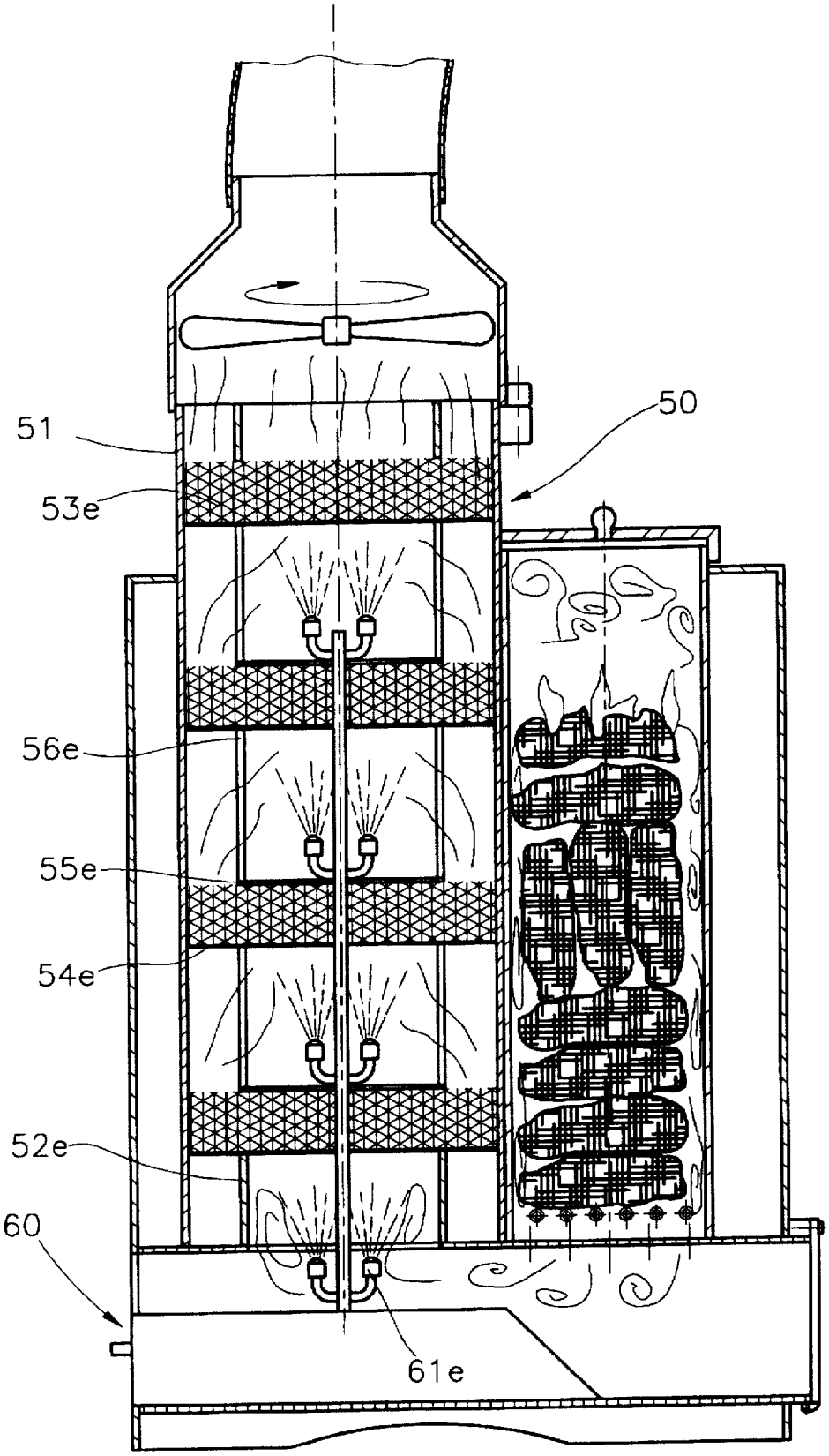
FIG. 9 is an elevational view in section of the present invention in a sixth embodiment.

FIG. 9 shows a sixth embodiment of the present invention, wherein the filter 50 has a modified inner tube 52*a*, as compared to the inner tube 52 of the first embodiment. Both the lower and the upper side of the inner tube 52*e* are open. The convex surface of the inner tube 52*e* has several holes 56*e*. In the spaces between the holes 56*e* several horizontal nets 54*e* are inserted, each carrying a layer of filter material 53*e*. The nets 54*a* are fastened to the inner side of the outer casing 51. On the upper side of each filter layer 53*a* a plate 55*e* is mounted, covering the cross section of the inner tube 52*e*. Smoke passing through one of the nets 54*a* from below passes further through the filter material 53*e* thereon and is then forced to leave the inner tube 52*e* by one of the plates 55*e*. In the space below each net 54*a* inside the inner tube 52*e* at least one sprinkler 61*e* is mounted. Thus the smoke is sprayed and filtered efficiently.

What is claimed is:

1. A combustion furnace for combustible rubbish comprising:

a main body, said main body includes an insertion hole near a lower end thereof, a plurality of combustion chambers, said combustion chambers are mounted inside said main body and spaced apart from each other, each said combustion chamber includes an open upper end and an open lower end, said upper ends of said combustion chambers extend above a top side of said main body;

a plurality of lids to cover said upper ends of said combustion chambers;

a filter mounted inside said main body, said filter comprises an outer casing with an open upper end and an open lower end, said upper end of said outer casing extends above said top side of said main body, an inner tube mounted in said outer casing such that a space is formed between said inner tube and said outer casing, said inner tube has a closed upper end, and open lower end, and a convex surface with a plurality of holes therein, and filter material in said space between said outer casing and said inner tube to filter smoke;

a separating plate that is fixed to an inner side of said main body above said insertion hole, said separating plate supports said combustion chambers and said filter, said separating plate includes a plurality of holes in areas corresponding to the location of said combustion chambers and said separating plate has an opening in an area corresponding to the location of said filter such that said smoke flows from said combustion chambers into said inner tube of said filter;

a sprinkling device inserted through said insertion hole of said main body so as to seal said insertion hole, said sprinkling device includes a sprinkler, said sprinkler is directed towards the entrance of said inner tube of said filter to disperse smoke in said inner tube; and a gas outlet mounted on said upper end of said outer casing of said filter to draw exhaust from said filter; wherein the combustible rubbish is burned in said combustion chambers and thereby generates heat and smoke, said heat is used for cooking and heating and said smoke flows from said combustion chambers through said plurality of holes of said separating plate and said opening of said separating plate into said inner tube of said filter, said smoke is therein sprinkled by said sprinkling device, said smoke further flows through said plurality of holes in said inner tube and passes through said filter material.

2. The combustion furnace for combustible rubbish according to claim 1, wherein said main body on said convex surface thereof below said separating plate has a coverable second hole, so as to remove ash from burning said combustible rubbish.

3. The combustion furnace for combustible rubbish according to claim 1, wherein said main body is further provided with a water inlet and a water outlet, allowing water for washing and bathing to be heated in said main body at the time of burning said combustible rubbish.

4. The combustion furnace for combustible rubbish according to claim 1, wherein one of said combustion chambers is connected to an outlet tube, which is attached to said lid thereof, so as to lead hot gas generated by burning said combustible rubbish to another furnace.

5. The combustion furnace for combustible rubbish according to claim 4, wherein said combustion chamber connected to said outlet tube does not contain any of said combustible rubbish.

6. The combustion furnace for combustible rubbish according to claim 1, wherein said sprinkling device has more than one sprinkler.

7. The combustion furnace for combustible rubbish according to claim 1, wherein said sprinkling device is further provided with a water tank.

8. The combustion furnace for combustible rubbish according to claim 7, wherein said water tank is movably insertable in said main body.

9. A combustion furnace for combustible rubbish according to claim 1, wherein said gas outlet is mounted on a rotatable holder which is connected to said filter.

10. The combustion furnace for combustible rubbish according to claim 9, wherein said gas outlet is movable to a position above one of said combustion chambers to draw up oily air generated by cooking on said combustion chamber.

* * * * *